United States Patent [19]

Ogle

[11] 4,250,783

[45] Feb. 17, 1981

[54] BALE CUTTING APPARATUS

[76] Inventor: Claude W. Ogle, 4961 Montcrest Dr., Chattanooga, Tenn. 37416

[21] Appl. No.: 954,468

[22] Filed: Oct. 25, 1978

[51] Int. Cl.[3] ..... B26D 5/08

[52] U.S. Cl. ..... 83/397; 83/909; 83/586; 83/587; 83/628; 29/564.3; 83/928

[58] Field of Search ..... 83/909, 640, 587, 586, 83/628, 397; 29/564.3; 130/1

[56] References Cited

U.S. PATENT DOCUMENTS

| | | | |
|---|---|---|---|
| 1,505,028 | 8/1924 | Karlson | 83/586 X |
| 2,547,375 | 4/1951 | Chernack | 83/586 X |
| 2,820,282 | 1/1958 | Schneider | 29/564.3 |
| 2,832,410 | 4/1958 | Soss | 83/586 X |
| 3,513,522 | 5/1970 | Thomson | 83/909 X |
| 4,020,726 | 5/1977 | Coats | 83/527 |

*Primary Examiner*—Donald R. Schran
*Attorney, Agent, or Firm*—Charles E. Baxley

[57] ABSTRACT

Apparatus for cutting straps wound on a bale of material in which the bale of material is brought into contact with a cutter blade which is forcibly retracted against the action of a spring whereafter the cutter element is released under the pressure of the compressed spring and is thrust forwardly against the bale to cut the straps on the bale.

21 Claims, 20 Drawing Figures

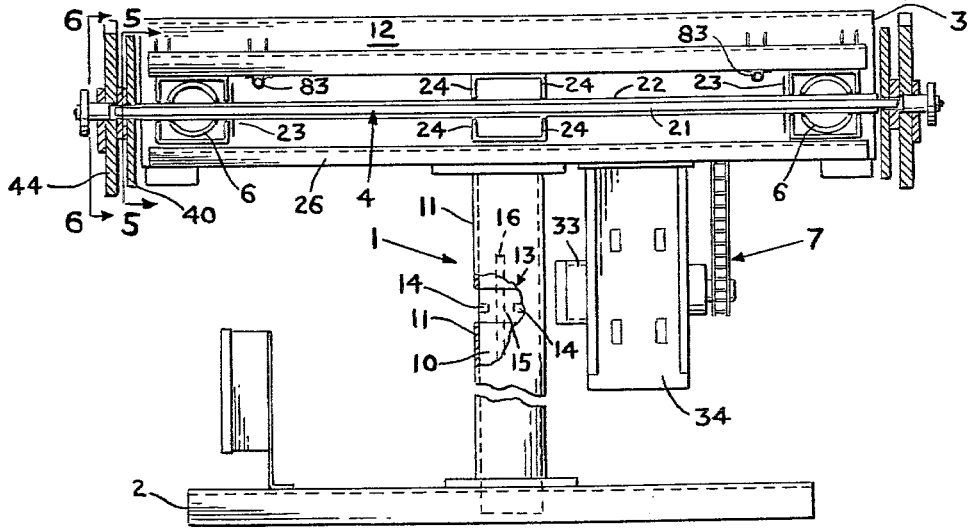
FIG. 1
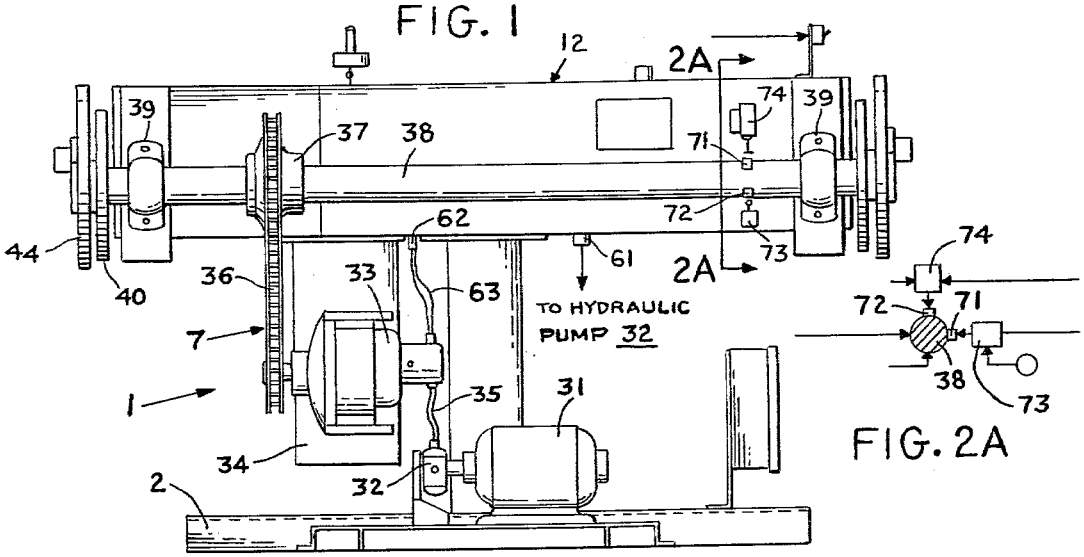
FIG. 2A
FIG. 2
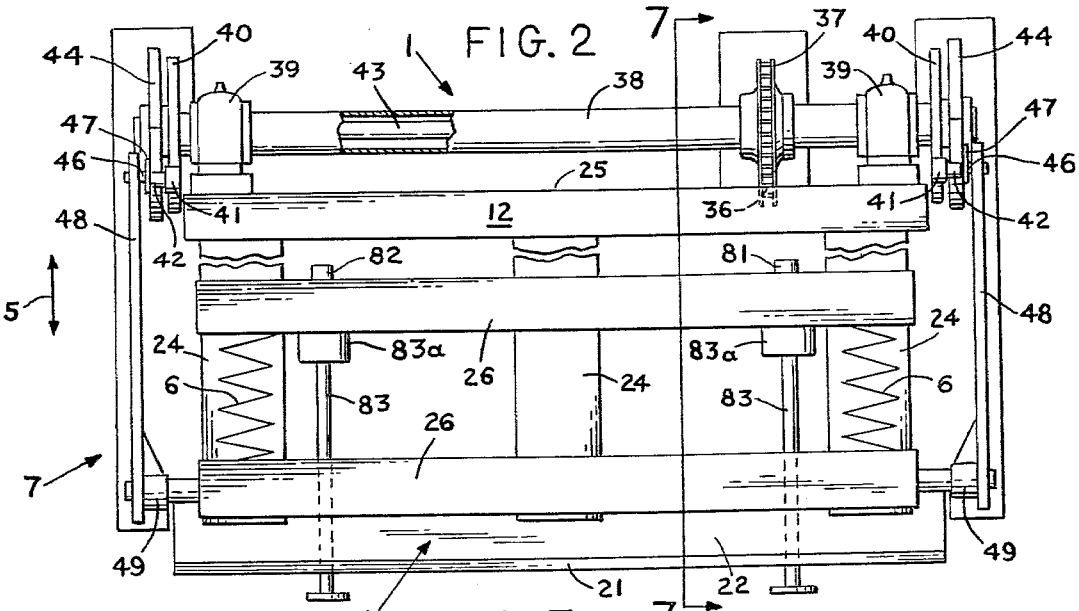
FIG. 3

BALE CUTTING APPARATUS

FIELD OF THE INVENTION

The invention relates to bale cutting apparatus particularly for operation primarily in an automated textile system in conjunction with a fork-lift truck or with a manual system employing a hand-truck.

PRIOR ART

Various types of apparatus and associated methods are known for cutting straps of baled materials.

In general, the cutting apparatus comprises rotatable cutter elements which are brought into engagement with the straps in the course of a linear transfer of the bale.

Such apparatus requires a relatively long period of time to sever a number of straps which may encircle a single bale. If a ganged assembly of cutters is employed, care must be taken to ensure that the cutters are reasonably aligned with the location of the straps and the apparatus is not adapted for co-operating with bales having straps of differing or irregular spacing.

Furthermore, in the conventional arrangements, it is necessary to place the bales onto a conveyor or other transport means and for this purpose a fork-lift truck or other vehicle is employed to transport the bales. This involves a succession of loading and unloading operations which are time consuming. Furthermore, after the bales have been cut, it is necessary either to reload the now cut bales onto the vehicle or to transport the but bales by means of a conveyor to a station for further operation.

U.S. Pat. No. 2,820,282 to Schneider discloses apparatus for removing ties from packages in which a bale is deposited onto a conveyor and advanced past rotating discs which sever the ties. The machine is relatively complex and suffers from the disadvantages as previously noted in connection with conventional rotary cutters.

U.S. Pat. No. 2,590,774 to Keller shows an arrangement operative in connection with paper box machines in which rotating cutters are employed for slitting the walls of a box. This arrangement is indicative of conventional types of cutting apparatus as previously noted.

U.S. Pat. No. 3,146,654 to Mathews et al discloses a bale sampler or slasher in which crosswise gashing of a pair of opposite long sides of a horizontally disposed cotton bale is carried-out. In this arrangement knives are transported along the sides of the bales to achieve a slashing of such sides.

U.S. Pat. No. 4,078,463 to Leonard et al discloses apparatus for cutting stacks of compressible sheet insulating materials in which the stack is elevated into compressed relation beneath one or more patterns supported on rigid rotatable uprights having offset portions and each pattern is cut with a fabric cutter while rotating the upright supporting the same.

SUMMARY OF THE INVENTION

An object of the invention is to provide bale cutting apparatus which is operative to cut straps wound on a bale of material in a single cutting operation.

A further object of the invention is to provide such apparatus in which a single cutting blade is operative to sever all of the straps of the bale. Another object of the invention is to provide such apparatus in which the bale is brought into contact with the cutting blade which subsequently effects a cutting operation on the straps.

A feature of the invention is the adaptability of the apparatus for use with a vehicle such as a fork-lift truck which can be advanced so that the bale of material is brought into contact with the apparatus.

A further feature of the invention is the adaptability of the apparatus for use with a hand-truck which can be employed to bring the bale of material into contact with the apparatus. of the invention, there is contemplated bale cutting apparatus for cutting straps wound on a bale of material, said apparatus comprising reciprocable cutter means movable between a retracted inoperative position and an extended operative position, and means operative in response to contact of a bale with the cutter means for retracting the cutter means to its retracted position and for thereafter propelling the cutter means to its extended position to cut the straps on the bale.

In further accordance with the invention, the means for retracting and propelling the cutter means comprises resilient means urging the cutter means to extended position, and power driven cam means for forcibly retracting the cutter means to inoperative position against the opposition of the resilient means and for releasing the cutter means for propelled movement to said operative position under the thrust of the resilient means.

It is contemplated, according to the invention, that the power driven cam means comprises a power drive means, a drive wheel driven in rotation by said power drive means and a load wheel drivingly coupled to said cutter means and driven by said drive wheel, said load wheel having a cam surface for driving the cutter means to said retracted position and then for releasing the cutter means.

The apparatus further contemplates a frame supporting said reciprocable cutter means for swivelable movement about an axis perpendicular to the direction of travel of the cutter means. Thereby the reciprocable cutter means can be brought into alignment with the contacting side surface of the bale.

In further accordance with the invention there is contemplated bale cutting apparatus for cutting straps wound on a bale of material, the apparatus having cutter means including a retracted inoperative position and an extended operative position, energy storage means opposing movement of the cutter means from the extended to the retracted position, power drive means for moving the cutter means from the extended position to the retracted position in opposition to the energy storage means, and control means activated by contact of a bale with the cutter means to energize the power drive means to move the cutter means to the retracted position, the power drive means including release means for releasing the power drive means from the cutter means in the retracted position to cause the cutter means to move to the extended position under the thrust of the energy storage means for severing straps wound on the bale.

The invention further contemplates a method of cutting straps wound on a bale of material, by contacting a bale of material having straps to be cut with a reciprocably movable cutter element, retracting the cutter element to a retracted position and propelling the cutter element to an extended position to cut the straps on the bale.

In further accordance with the invention, the bale of material is transported towards the cutter element in the direction of retraction of the cutter element.

In still further accordance with the invention, as the cutter element is retracted, energy is stored and then subsequently released to effect the propelling of the cutter element.

The invention further forsees that the forcible retraction of the cutter element is initiated in response to application of a predetermined pressure by the bale of material against a sensing element.

The invention will be described in detail hereafter in conjunction with the appended drawings.

BRIEF DESCRIPTION OF THE DRAWINGS

FIG. 1 is a front elevational view of the bale cutting apparatus according to the invention shown partly broken away.

FIG. 2 is a rear elevational view of the apparatus.

FIG. 2A is a sectional view taken on line 2A—2A in FIG. 2.

FIG. 3 is a top plan view with the safety guard removed.

DETAILED DESCRIPTION

The invention will be described hereafter in conjunction with bale cutting apparatus for severing bands on a bale of material. The term "bands" is intended to cover straps, ties and connectors of metal, plastic, twine or the like. The material can be cotton, cloth, plastic or the like. The invention is not particularly concerned with the nature of the bands or of the material apart from their cooperation with the various elements of the apparatus as will be evident hereafter.

Figure 14:
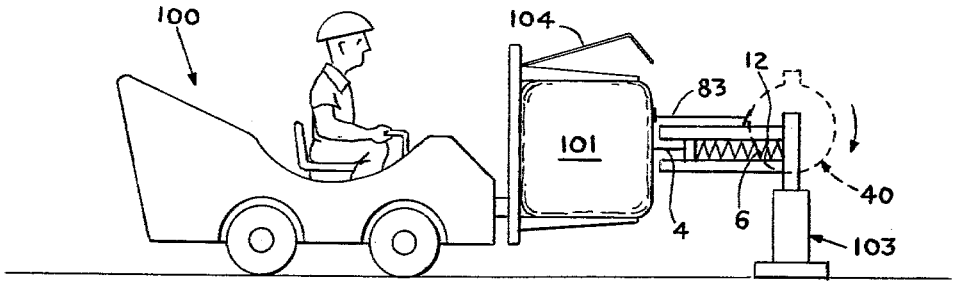
Figure 15:
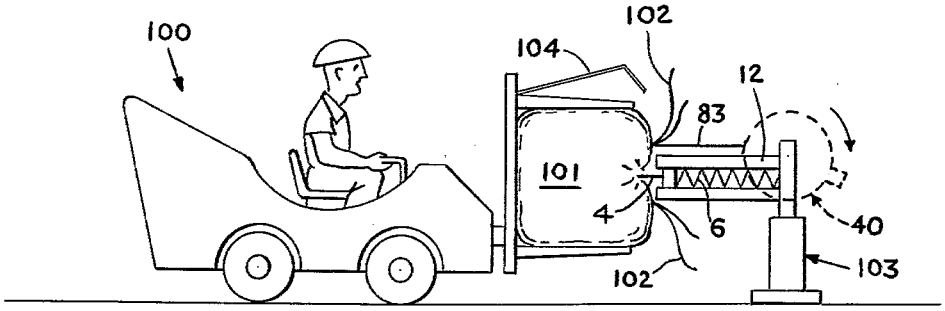

Referring to the drawing, the bale cutting apparatus of the invention as shown in the illustrated embodiment comprises a frame assembly 1 inclusive of a base 2 adapted for being secured to a horizontal support surface such as the floor of a shop or the like. The base 2 supports a carrier 3 for limited rotation in a manner to be explained later. The carrier 3 supports an assembly inclusive of a cutter blade 4 for reciprocatory movement in the directions of arrows 5 (as seen in FIG. 3) between a fully retracted position as shown in FIG. 14 and a fully extended position as shown in FIG. 15. The cutter blade 4 is subjected to the action of springs 6 which serve as an energy storage means opposing movement of the cutter blade from its extended to its retracted position and which releases the stored energy to the blade in its retracted position to propel the same forwards for cutting the straps of a bale as will be explained in greater detail later. The cutter blade 4 is driven from its extended position to the retracted position by a power drive means 7 against the opposition of the energy storing springs 6.

The frame assembly 1 comprises a fixed inner sleeve 10 which is secured to base 2 and an outer sleeve 11 which is rotatably mounted on sleeve 10 and supports an upper frame portion 12 which carries the cutter blade 4. The upper frame portion 12 is rotatable with sleeve 11 on fixed sleeve 10 within angular limits as established by stop means 13 best seen in FIG. 1. The stop means 13 comprises two angularly spaced stop members 14 on the sleeve 10 establishing a gap 15 therebetween in which a projection 16 on sleeve 11 is permitted to travel within the angular limits of the gap 15. The angular limits of gap 15 may be established to permit rotation of upper frame portion 12 by fifteen degrees in either direction from a nominal center position thereby giving a capability of a total angular movement of thirty degrees. As will be seen later this angular capability of movement of the upper portion permits alignment of a bale of material with the cutter blade assembly 4 in an initial phase of operation.

The cutter blade assembly 4 comprises a cutter blade 21 supported by a carrier 22 which is reciprocably guided in spaces 23 formed between upper and lower longitudinal frame elements 24 at the center and the sides of upper frame portion 12 as best seen in FIG. 3. Each of the spaces 23 between the frame elements 24 at the sides of frame portion 12 guidably receives a power spring 6 which permits the blade assembly 4 to travel between the retracted and extended positions. The forward ends of the springs 6 are secured to the carrier 22 of the blade 21 and the rear ends of the springs 6 are secured to and bear against a rigid transverse member 25 of the upper frame portion 12. The upper frame portion 12 further comprises transverse cross-brace members 26 secured to longitudinal elements 24.

The power drive means 7 for retracting the cutter blade 4 from its extended to its retracted position comprises an electric motor 31 coupled in driving relation to a pump 32 in turn drivingly connected to a hydraulic motor 33. The motor 31 and the pump 32 are secured to the base 2 and the hydraulic motor 33 is mounted on a support 34 secured to the upper frame portion 12. The pump 32 is connected to the motor 33 by means of flexible hydraulic connection lines 35. The hydraulic motor drives a chain 36 which engages a sprocket 37 mounted on an outer drive shaft 38. The ends of shaft 38 are rotatably supported in bearings 39 secured to the upper frame portion 12.

Figure 4:
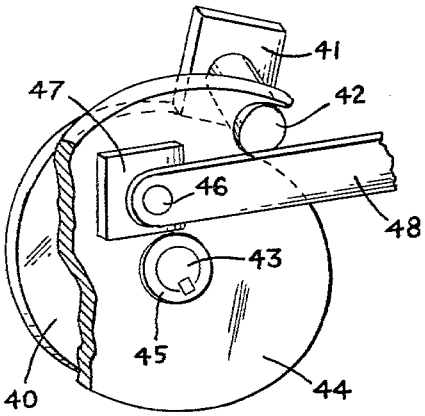
FIG. 4 is a perspective view showing a detail of the apparatus.
Figure 5:
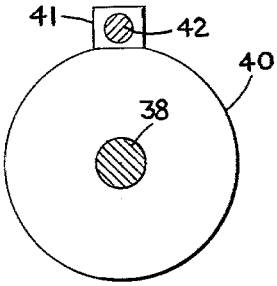
FIG. 5 is a section taken on line 5—5 in FIG. 1.
Figure 6:
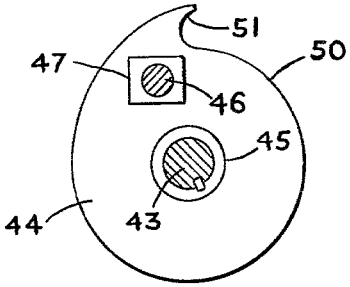
FIG. 6 is a section taken on line 6—6 in FIG. 1.

Secured to outer ends of drive shaft 38 extending beyond bearings 39 are drive wheels 40 each of a construction best shown in FIG. 5. Therein is seen a rigid plate 41 secured to the outer periphery of each drive wheel 40 which carries a projecting stub shaft 42 extending laterally outwards.

Rotatably mounted within outer shaft 38 is an inner load shaft 43 which is freely rotatable within shaft 38 and supported by bearings (not shown) therein. The inner shaft 43 extends beyond the ends of the outer shaft 38 and fixedly support load wheels 44 on eccentric bearings 45. Each load wheel has a stub shaft 46 secured thereto by a rigid connecting plate 47 and each stub shaft 46 is pivotably connected to a rigid connecting rod 48. Each connecting rod 48 is pivotably connected through a bearing 49 to the carrier 22 of the cutting blade 21.

Each load wheel 44 has a peripheral surface 50 constituted as a surface of epicycloidal shape which forms a projection 51 thereon. The surface 50 provides a cam surface for stub shaft 42 as will be explained hereafter in conjunction with FIGS. 10A–10C.

Figures 10A, 10B, 10C:
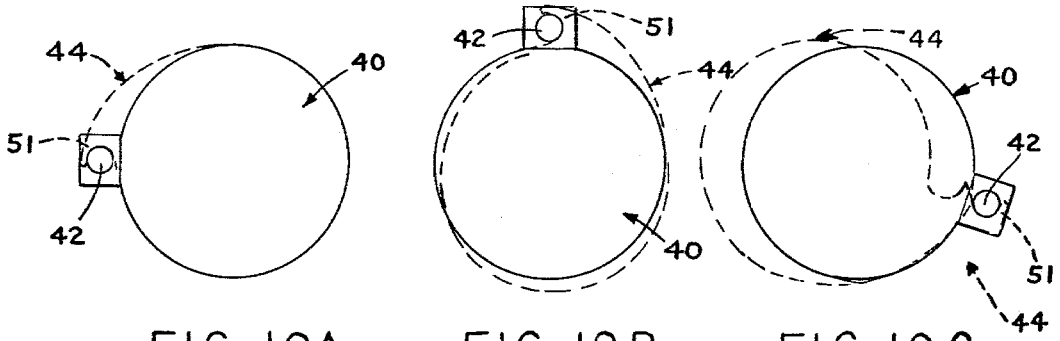
FIGS. 10A–10C are diagrammatic illustrations showing the position of a drive wheel and a load wheel of the apparatus.

In FIG. 10A the stub shaft 42 on drive wheel 40 is engaged with the projection 51 in a position in which the springs 6 are fully relaxed and the cutting blade 4 is in its fully extended position. As the drive wheel 40 undergoes clockwise rotation under the drive action of the hydraulic motor 33, as will be explained later, the load wheel 44 is driven by the drive wheel 40 through the intermediate position as shown in FIG. 10B to the position as shown in FIG. 10C where the springs are compressed to the maximum extent to their fully retracted position. In the position as shown in FIG. 10C, the stub shaft 42 escapes from the projection 51 on the load wheel 44 which now enables the load wheel 44 to become "free-wheeling" whereupon the fully compressed springs 6 can propel the blade 4 forcibly to its extended position to effect a cutting operation on the straps of the bale of material as will be explained later.

The hydraulic drive motor 33 is capable of exerting a peak pressure which is considerably greater than required to retract the springs 6 and, by way of example, can develop a peak pressure 30% in excess of the force necessary to retract the springs fully. The rigid member 25 on the upper frame portion 12 is hollow in part and suitably partitioned to form a closed hydraulic reservoir containing hydraulic fluid. The reservoir has a coupling 61 which leads via a flexible line (not shown) to the hydraulic pump 32. A coupling 62 on the reservoir leads to the hydraulic motor 33 to complete the return line of the hydraulic circuit connecting the reservoir, pump and hydraulic motor.

Figure 7:
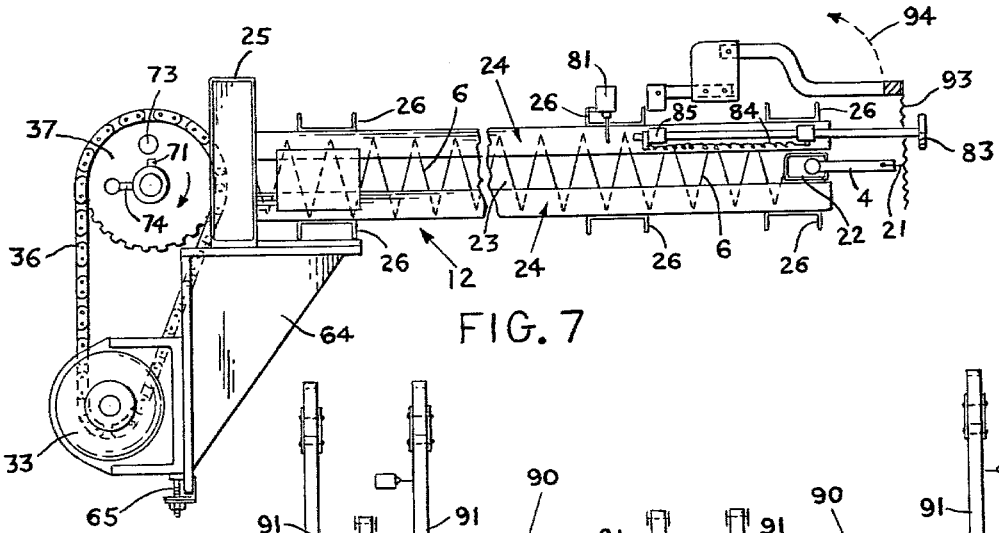
FIG. 7 is a section taken on line 7—7 in FIG. 3.
Figure 8:
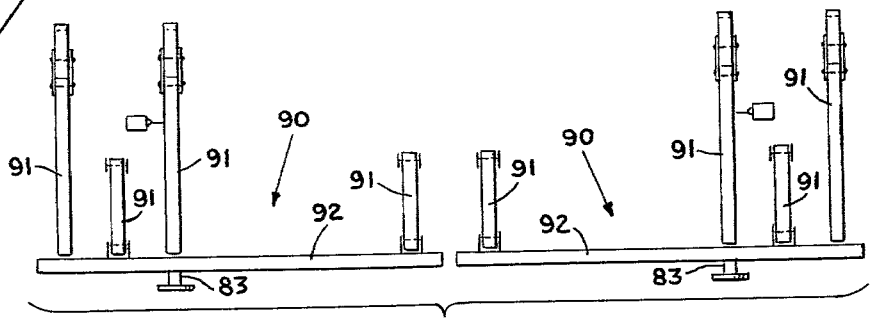
FIG. 8 is a top plan view of the safety guard.

The hydraulic motor 33 drives the sprocket 37 at a relatively slow speed of, for example, 1.75 rpm depending on load conditions. As seen in FIG. 7, the upper frame portion 12 has reinforcing gussets 64 for reinforcing the connection of the hydraulic motor 33 to the frame portion. Adjustment bolts 65 connect the hydraulic motor 33 to the frame portion 12 to permit the take-up of any slack in chain 36.

The bale cutting apparatus is controlled in a manner such that when a bale of material is brought into contact with the cutter blade 4, the hydraulic motor will be activated to drive the cutter blade 4 to its retracted position by the action of the drive wheel 40 and the load wheel 44 in traveling from the position shown in FIG. 10B to the position shown in FIG. 10C whereupon the cutter blade will be released and permitted to be propelled forwardly under the thrust of the compressed springs 6. The drive wheel 40 then travels to the position as shown in FIG. 10A and re-engages the load wheel 44 to bring the same to the position at FIG. 10B whereupon the bale cutting apparatus awaits renewed contact with a further bale of material.

The contro' apparatus for controlling the timing operation and the sequence of operations as shown in FIGS. 10A to 10C will next be explained hereafter.

As clearly seen in FIG. 2A, the shaft 38 carries on its outer surface a pair of projections 71 and 72 in angularly spaced relation. Facing the projections in the same plane thereas are normally closed limit switches 73 and 74 adapted for being sequentially operated by the projections 71 and 72. The switches 73 and 74 are normally closed and are angularly offset on shaft 38 by ninety degrees so that switch 74 is first actuated by projection 71 to be placed into opens state whereafter projection 71 then open switch 73. At this stage, the normally closed switch 74 is also opened by projection 72. As shaft 38 continues to rotate, projection 72 will reach a position to open switch 73.

Figure 9:
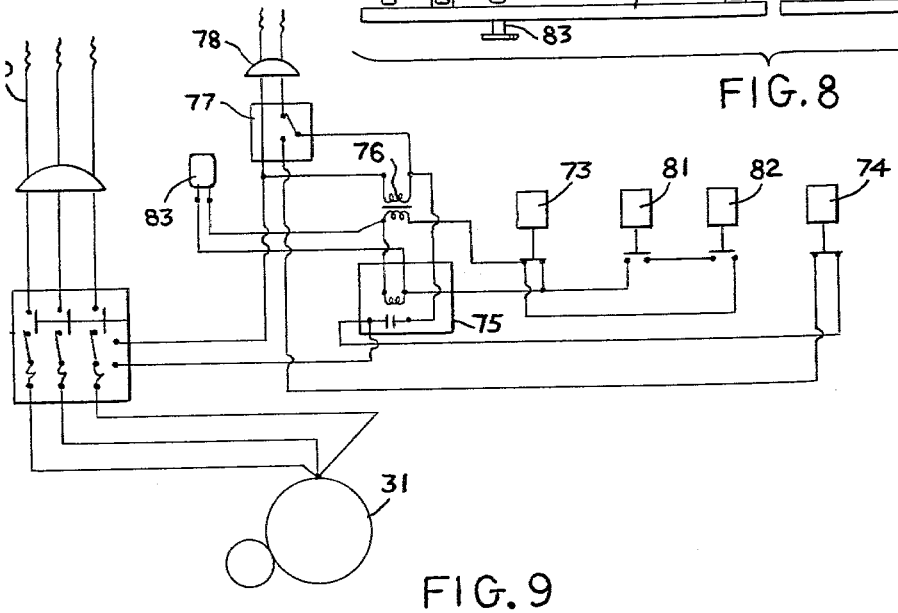
FIG. 9 is a wiring diagram.

Referring to the circuit diagram in FIG. 9, therein is shown the arrangement of limit switches 73 and 74 connected in circuit with a relay 75, a step-down transformer 76, a three-way switch 77 and a power supply 78. The electrical motor 31 which drives the hydraulic pump 32 is connected through a relay power switch 79 to a three-phase power supply 80. The relay switch 79 is controlled by the relay 75. Additionally connected in the circuit are two switches 81 and 82 in series with limit switch 73. A bell 83 or other suitable alarm means is connected in parallel with the relay 75 to be energized concurrently therewith.

The switches 81 and 82 are mounted on a cross brace 26 in the path of actuator arms 83 slidably supported in guides **83*a* for undergoing axial travel therein. Each actuator arm 83 is connected via a spring 84 to a plunger 85 which is positioned to actuate a respective switch 81 or 82. The spring 84 is calibrated to resist displacement of the plunger 85 until the arm 83 is subjected to a predetermined force after which the plunger 85 will travel with the projection arm 83 and trip the corresponding switch 81 or 82**.

The projecting arms 83 extend beyond the front edges of the cutting blade 4 and when a bale of material is brought into position to contact the projecting arms 83, the bale will force the arms rearwardly in the guides **83*a* to a position at which the bales will be in contact with the cutting blade. At this point the plungers 85 will trip the switches 81 and 82. This will activate the relay 75 to cause the motor switch relay 79 to close whereupon the electric motor 31 will be actuated. The drive wheel 40 will now be driven by the hydraulic motor 33 from the position shown in FIG. 10B to the position shown in FIG. 10C. The load wheel 44 will be released at the position shown in FIG. 10C to allow the cutter blade 4 to be propelled forwards under the thrust of the springs 6 and the drive wheel 40 will continue to the position as shown in FIG. 10A. The operation will be halted when the switch 77 is in the off position and the limit switch 74 is actuated to its open position by projection 71. This of course presumes that the bale of material has been withdrawn from the projection arms 83 so that the switches 81 and 82 have been opened. If the switch 77 remains in its closed position the electric motor 31 will continue to drive the hydraulic motor until switch 73 is opened corresponding to the position as shown in FIG. 10B. In this position the springs 6** are approximately in their 50% loaded condition.

In order to protect the projecting arms 83 and prevent inadvertent operation of switches 81 and 82 to effect operation of the cutting apparatus, a safety guard assembly is provided comprising two safety guard units 90 each associated with a respective projecting arm 83. Each unit 90 is pivotably mounted on a cross-brace 26 and is composed of a skeletal frame including longitudinal members 91 and transverse member 92 overlying the respective projecting arm 83. A person accidentally leaning against either of the safety guard units 90 would not accidentally start the machine. The transverse members 91 of the safety guard units overlie the blade 4 and carry a flexible cover 93 extending in front of the blade 4. The arms 83 pass through slots in the cover 93. The guard units are coupled to plungers 85 to be pivotably movable thereby when the plungers travel towards switches 81 and 82. The guard units 90 are then pivotably moved in the direction of arrow 94 and thereby permit continued movement of a bale in the direction to complete the closure of switches 81 and 82.

The operation of the device is given hereafter in conjunction with FIGS. 11 to 17.

Figure 11:
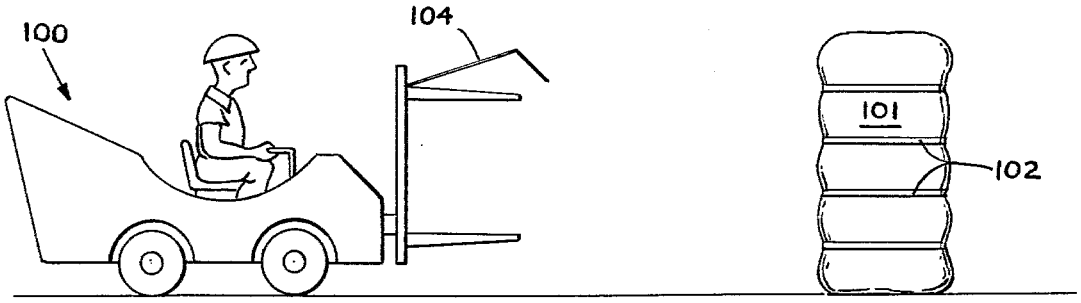
FIGS. 11–17 diagrammatically show the operation of the bale cutting apparatus.
Figure 12:
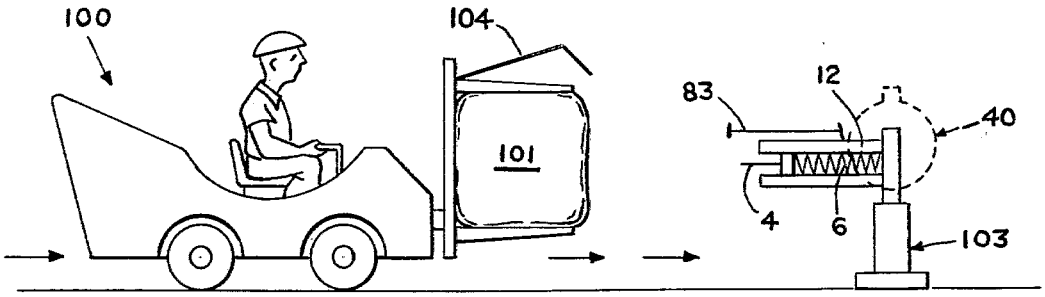
Figure 13:
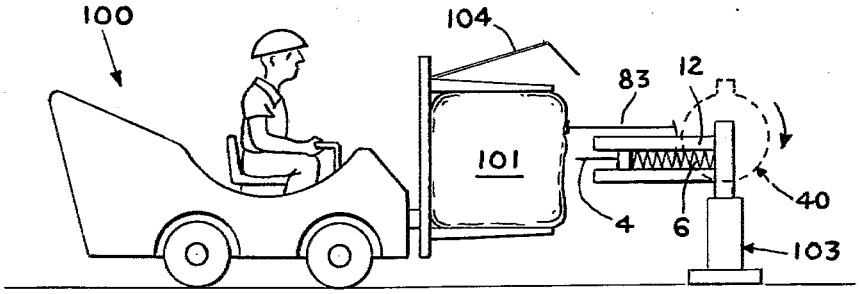

In FIG. 11 there is seen a fork truck 100 which is brought into an approach position with respect to a bale of material 101 which are wound with straps or bands 102. The bale is placed into a horizontal position on the arms of the fork truck as seen in FIG. 12. The fork truck is then brought into an approach position with respect to the bale cutter shown diagrammatically at 103 in FIG. 12. The drive wheel 40 and the load wheel 44 are in the position as shown in FIG. 10B and the spring 6 is in the partially compressed position. The blade 4 is in its partially retracted intermediate position corresponding to the position of the wheels as shown in FIG. 10B. When the bale of material has been brought into the position as shown in FIG. 13, the projecting arms 83 will come into contact with the bale. The frame 12 which supports the arms 83 will swivel freely within the limits of stop means 13 to accommodate itself to the bale of material so that both arms 83 will contact the bale. The bale thereafter comes into contact with the blade 4 as seen in FIG. 14 and will be pressed squarely thereagainst, the frame 12 undergoing swivel movement to accommodate any misalignment. As the fork truck is further advanced it will cause the projecting arms 83 to be retracted in the direction of closure of switches 81 and 82. The action of the pressure of the bale in displacing the projecting arms 83 in the direction of closing the switches will be accompanied by a pivotal movement of the safety guard units 90 to raised position. At the time of closure of the switches 81 and 82, the bale of material will be applied against the cutting blade 4 with a pressure of approximately 60 psi. Adjustment of the pressure can be made by adjusting the spring 84.

The closure of switches 81 and 82 will activate relay 74 which, in turn, operates the motor switch relay 79 energizing the electrical motor 31 which now drives the hydraulic motor 33. The drive wheel 40 then proceeds from the position shown in FIG. 10B to the position shown in FIG. 10C driving the load wheel 44 therewith to produce full compression of the springs 6. The load wheel 44 is now in free-wheeling position allowing the fully retracted springs 6 to be released and to be propelled under the thrust of the springs into the bale at a high rate of speed and pressure which can be of the order of 40,000 inch pounds. This is the position shown in FIG. 15 where the straps 102 are being severed. The fork truck 100 carries a protective canopy 104 which confines the severed ends of the straps and prevents any injury to the driver of the vehicle.

The transverse extent of the blade is such that all of the straps on the bale of material will be severed in a single operation.

Figure 16:
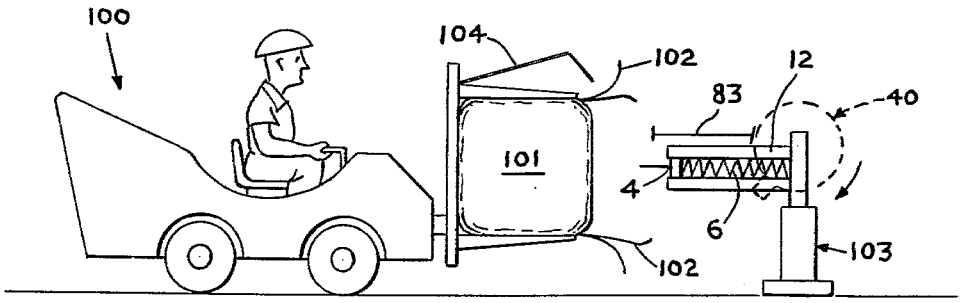
Figure 17:
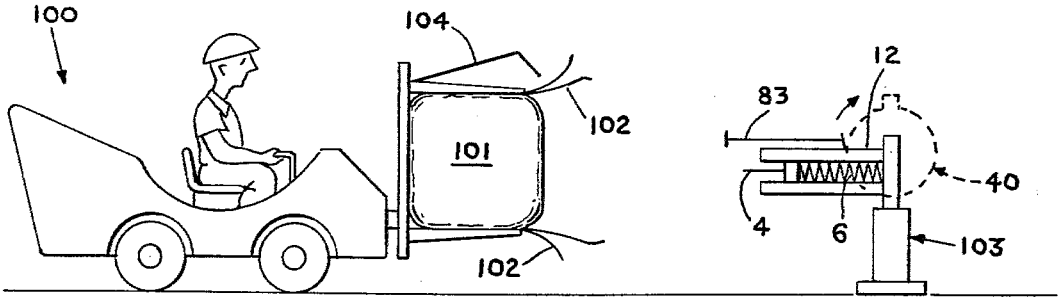

The operator then backs the lift truck away from the bale cutting apparatus as shown in FIG. 16. The electric motor continues to be driven through the position as shown in FIG. 10C towards the position shown in FIG. 10A. As long as the manual switch 77 remains in the closed position the bale cutting apparatus remains in the operative position until the switches 81 and 82 are again closed by a further bale in a subsequent cutting operation. If the manual switch 77 is brought to the open position, the bale cutting apparatus will be halted in the position shown in FIG. 10A with the spring in completely relaxed position and the blade in fully extended position. Subsequent activation of the manual control switch 77 to the "on" position will energize the electric motor and the hydraulic system which will move the cutter blade to the intermediate retracted position represented by the arrangement of the drive wheel and load wheel as shown in FIG. 10B.

Although the invention has been described in conjunction with operation by a fork truck, it is evident that the same operation could be undertaken with a manually propelled hand-truck.

While the invention has been described in conjunction with a preferred embodiment thereof, it will become apparent to those skilled in the art that numerous modifications and variations can be made within the scope and spirit of the invention as defined by the appended claims.

I claim:

1. Bale cutting apparatus for cutting straps wound on a bale of material, said apparatus comprising reciprocable cutter means having an initial position and being movable between a retracted inoperative position and an extended operative position, and means operative in response to contact of a bale with the cutter means in said initial position for retracting the cutter means to its retracted position and for thereafter propelling the cutter means to its extended position to cut the straps on the bale.

2. Bale cutting apparatus as claimed in claim 1 wherein the means for retracting and propelling the cutter means comprises resilient means urging the cutter means to extended position, and power driven cam means for forcibly retracting the cutter means to inoperative position against the opposition of the resilient means and for releasing the cutter means for propelled movement to said operative means under the thrust of the resilient means.

3. Bale cutting apparatus as claimed in claim 2 wherein said power driven cam means comprises a power drive means, a drive wheel driven in rotation by said power drive means and a load wheel drivingly coupled to said cutter means and driven by said drive wheel, said load wheel having a cam surface for driving the cutter means to said retracted position and then releasing the cutter means.

4. Bale cutting apparatus as claimed in claim 3 wherein said cam surface includes a projection and a peripheral surface which is eccentric with respect to the axis of rotation of said drive wheel.

5. Bale cutting apparatus as claimed in claim 4 comprising a stub shaft secured to said drive wheel and positioned thereon to engage said projection at a first position of the load wheel corresponding to the extended position of the cutter means to rotate said load wheel to a second position corresponding to the retracted position of the cutter means at which the stub shaft is released by said projection.

6. Bale cutting apparatus as claimed in claim 5 wherein said load wheel passes through a third position intermediate the first and second positions at which the cutter means is partially retracted, said third position corresponding to said initial position of said cutter means, the apparatus further comprising switch means for halting the drive wheel in a position to hold the load in said third position.

7. Bale cutting apparatus as claimed in claim 6 wherein said switch means comprises sensing switches operative in response to pressure from the bale whose straps are to be cut for coupling the drive wheel and the power drive means to drive the load wheel to said second position.

8. Bale cutting apparatus as claimed in claim 7 wherein said power drive means comprises a hydraulic drive motor coupled to said drive wheel, a hydraulic pump drivingly coupled to said motor, an electric motor drivingly coupled to said pump and means for energizing said electric motor inclusive of said sensing switches.

9. Bale cutting apparatus as claimed in claim 8 wherein said means for energizing said electric motor includes alarm means actuated in common with said electric motor.

10. Bale cutting apparatus as claimed in claim 1 comprising a frame supporting said reciprocable cutter means for swivelable movement about an axis perpendicular to the direction of travel of the cutter means.

11. Bale cutting apparatus as claimed in claim 10 comprising stop means for limiting the swivel travel of the frame.

12. Bale cutting apparatus as claimed in claim 1 in combination with protective canopy means for confining the cut ends of the straps after cutting by the cutter means.

13. Bale cutting apparatus for cutting straps wound on a bale of material, said apparatus comprising cutter means having a retracted inoperative position and an extended operative position, energy storage means opposing movement of the cutter means from the extended to the retracted position, power drive means for moving said cutter means from the extended position to the retracted position in opposition to the energy storage means, and control means activated by contact of a bale with the cutter means to energize the power drive means to move the cutter means to said retracted position, said power drive means including release means for releasing the power drive means from the cutter means in said retracted position to cause said cutter means to move to said extended position under the thrust of said energy storage means for severing straps wound on the bale.

14. Bale cutting apparatus as claimed in claim 13 wherein said power drive means comprises a power source, a drive wheel driven in rotation by said power source and a load wheel drivingly coupled to said cutter means and driven by said drive wheel.

15. Bale cutting apparatus as claimed in claim 14 wherein said power drive means further comprises a rigid connecting rod drivingly coupling said load wheel and said cutter means.

16. Bale cutting apparatus as claimed in claim 14 wherein said release means comprises releasable coupling means between said drive wheel and said load wheel.

17. Bale cutting apparatus as claimed in claim 16 wherein said releasable coupling means comprises a projection of one wheel and a stub shaft on the other wheel, said projection and stub shaft being rotatable with their respective wheels about eccentric axes such that the projection and stub shaft are in drivingly coupled relation between the extended and retracted positions of the cutter means.

18. Bale cutting apparatus as claimed in claim 17 wherein said load wheel passes through an intermediate position at which the cutter means is partially retracted, said control means interrupting said power drive means and holding said load wheel in said intermediate position until the cutting means is contacted by the bale.

19. Bale cutting apparatus as claimed in claim 18 wherein said control means includes means for reactivating said power drive means to drive the load wheel from said intermediate position to said retracted position when the cutter means is contacted by the bale.

20. Bale cutting apparatus as claimed in claim 19 wherein said means for reactivating said power drive means comprises an electrical control circuit and pressure sensitive switches in said control circuit.

21. Bale cutting apparatus as claimed in claim 1 comprising displaceable cover means for covering said cutter means in said initial position and for uncovering said cutter means in said retracted and extended positions.

* * * * *